US008601733B2

(12) United States Patent
Gabay et al.

(10) Patent No.: US 8,601,733 B2
(45) Date of Patent: Dec. 10, 2013

(54) MAGAZINE ADD-ON

(76) Inventors: Guy Gabay, Kiryat-Ono (IL); Yosef Amar, Kiryat-Ono (IL)

( * ) Notice: Subject to any disclaimer, the term of this patent is extended or adjusted under 35 U.S.C. 154(b) by 138 days.

(21) Appl. No.: 13/162,697

(22) Filed: Jun. 17, 2011

(65) Prior Publication Data

US 2011/0308125 A1 Dec. 22, 2011

(30) Foreign Application Priority Data

Jun. 22, 2010 (IL) ..... 206546

(51) Int. Cl.
*F41A 9/62* (2006.01)

(52) U.S. Cl.
USPC ..... 42/1.02

(58) Field of Classification Search
USPC ..... 42/1.01, 1.02, 1.03
See application file for complete search history.

(56) References Cited

U.S. PATENT DOCUMENTS 5,779,114 A * 7/1998 Owens ..... 224/193
5,826,360 A * 10/1998 Herold et al. ..... 42/1.02
7,730,654 B2 * 6/2010 Kim ..... 42/1.02

FOREIGN PATENT DOCUMENTS

WO 2008132739 A2 6/2008

* cited by examiner

*Primary Examiner* — Stephen M Johnson
(74) *Attorney, Agent, or Firm* — Pearl Cohen Zedek Latzer Baratz LLP

(57) ABSTRACT

A magazine add-on comprising a platelet arranged to replace the bottom platelet of the magazine and allow measuring the distance, e.g., via an aperture in the platelet, to the magazine's spring-loaded follower either mechanically by an elastic strap, optically by a rangefinder or by measuring the pressure applied by the spring on the platelet. The add-on further displays a number of bullets left in the magazine in a window, either mechanically by numbers on the back of the strap, or electronically on a display attached to the window and connected to the optical or pressure sensor. The add-on is reusable and may be separated and re-attached to various magazines.

8 Claims, 6 Drawing Sheets

MAGAZINE ADD-ON

BACKGROUND

1. Technical Field

The present invention relates to the field of weaponry, and more particularly, to counting bullets in a magazine.

2. Discussion of Related Art

Weapon magazines usually lack indications of the remaining number of bullet, which may be very important and even crucial to the soldier.

WIPO publication No. 2008132739, which is incorporated herein by reference in its entirety, discloses a magazine status indicator.

BRIEF SUMMARY

Embodiments of the present invention provide an apparatus comprising: a housing attachable to a bottom of a magazine having a spring-loaded follower, the housing having a window; a platelet arranged to replace a bottom platelet of the magazine and comprising a connector connectable to the spring, and an aperture; means for measuring, through the aperture, a distance between the follower and a point in the housing, the means for measuring integrated within the housing; and means for displaying a number of bullets left in the magazine, through the window, according to the measured distance, wherein the apparatus is arranged to be added on the magazine and display the number of bullets left in the magazine.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
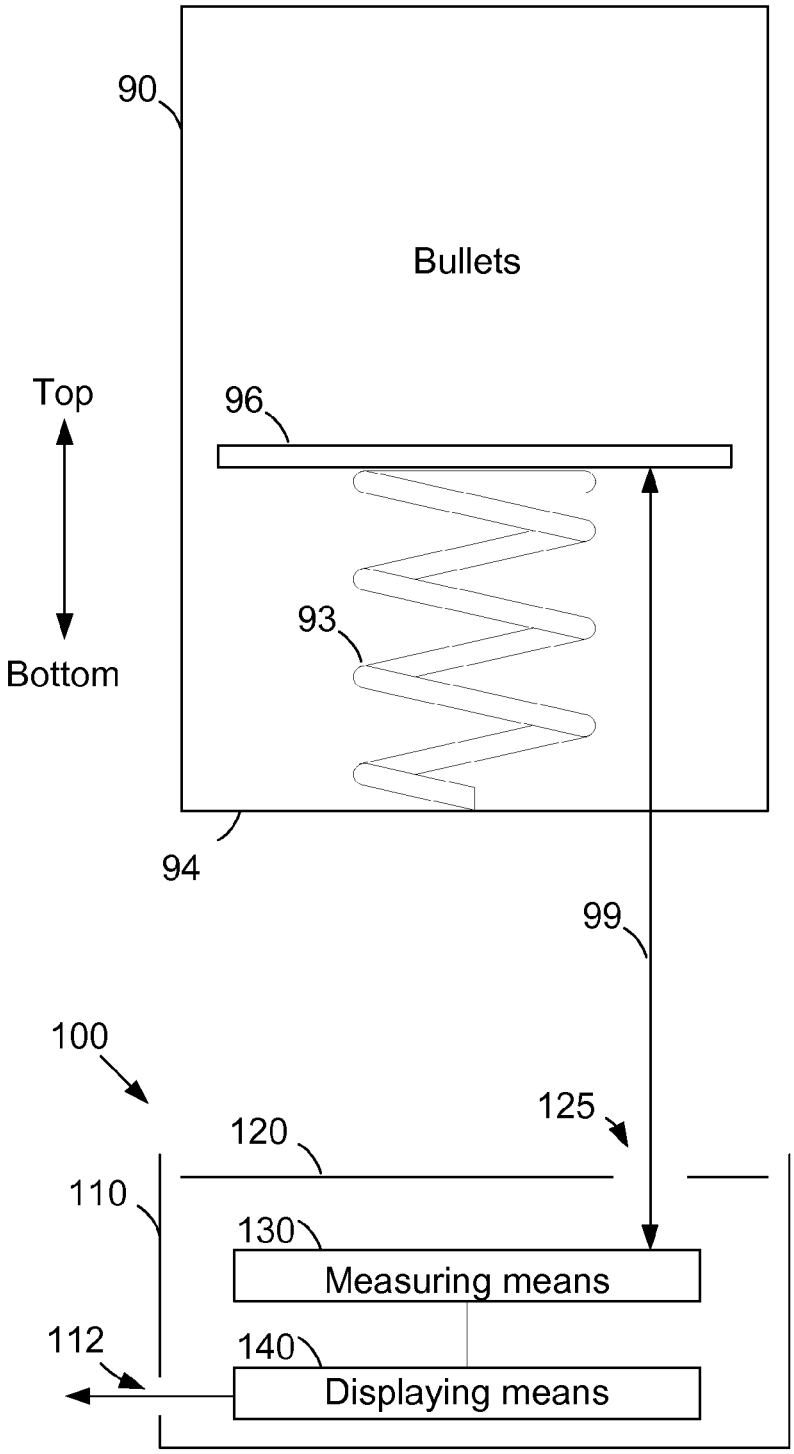
FIG. 1 is a high level schematic block diagram of an add-on apparatus and a magazine having a spring-loaded follower, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 2:
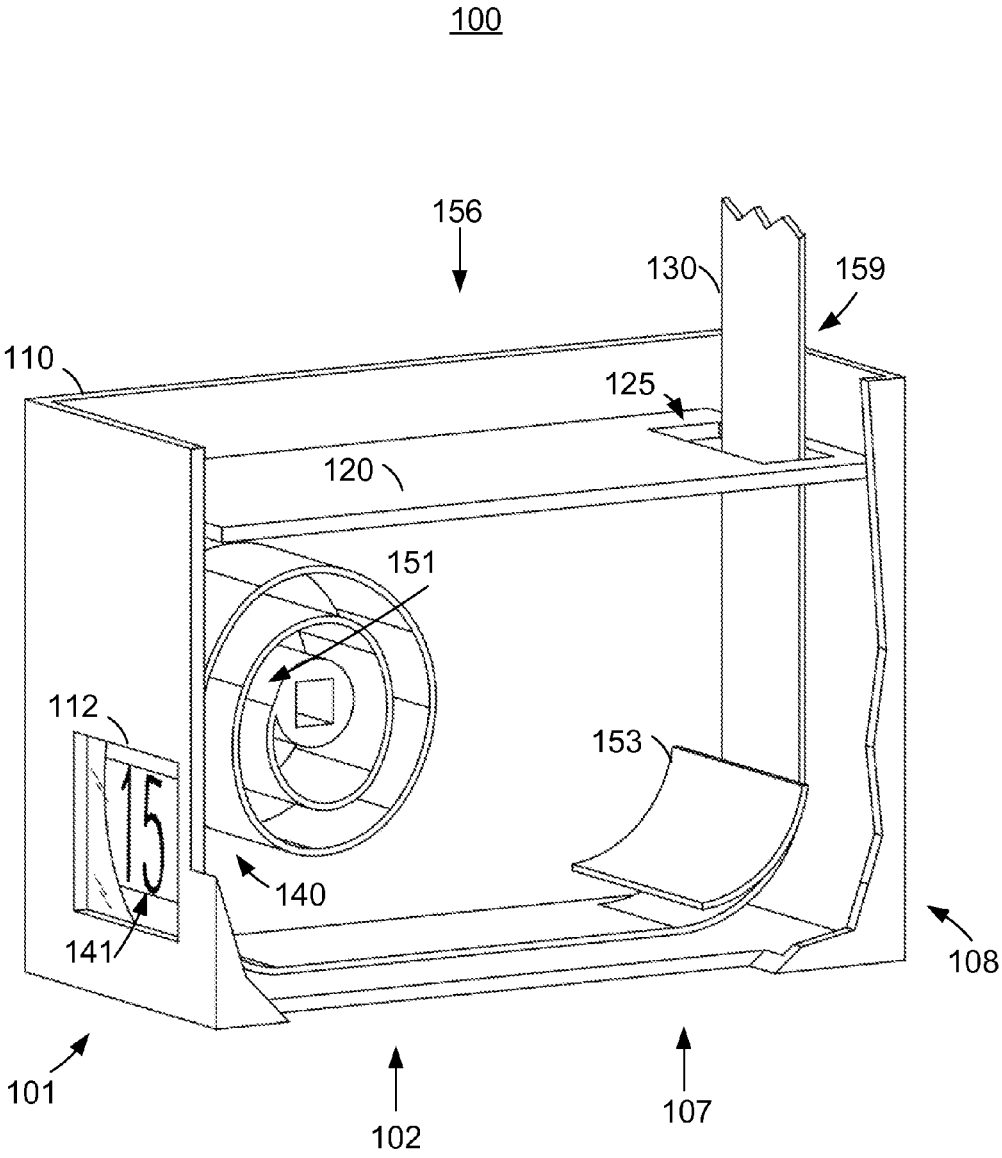
FIG. 2 is a schematic illustration of the apparatus, according to some embodiments of the invention.

FIG. 1 is a high level schematic block diagram of an add-on apparatus 100 and a magazine 90 having a spring-loaded follower 96, according to some embodiments of the invention. FIG. 2 is a schematic illustration of apparatus 100, according to some embodiments of the invention. Apparatus 100 is arranged to be added on magazine 90 having spring-loaded follower 96 (see FIGS. 3A through 4B) and display the number of bullets left in magazine 90. Apparatus 100 comprises a housing 110 attachable to a bottom of a magazine (by clips or other connector types), and a platelet 120 arranged to replace a bottom platelet of magazine 90 and comprises a connector (not shown) connectable to spring 93. Platelet 120 has an aperture 125 through which a distance 99 between follower 96 and a point in housing 110 is measured by means for measuring 130 integrated within housing 110. Apparatus 100 further comprises means 140 for displaying a number of bullets left in magazine 90, through a window 112 in housing 110, according to measured distance 99.

Measuring distance 99 may be carried out mechanically by an extendable strap 150, or by sensors (160, 170) as illustrated in the following figures.

Figure 3A:
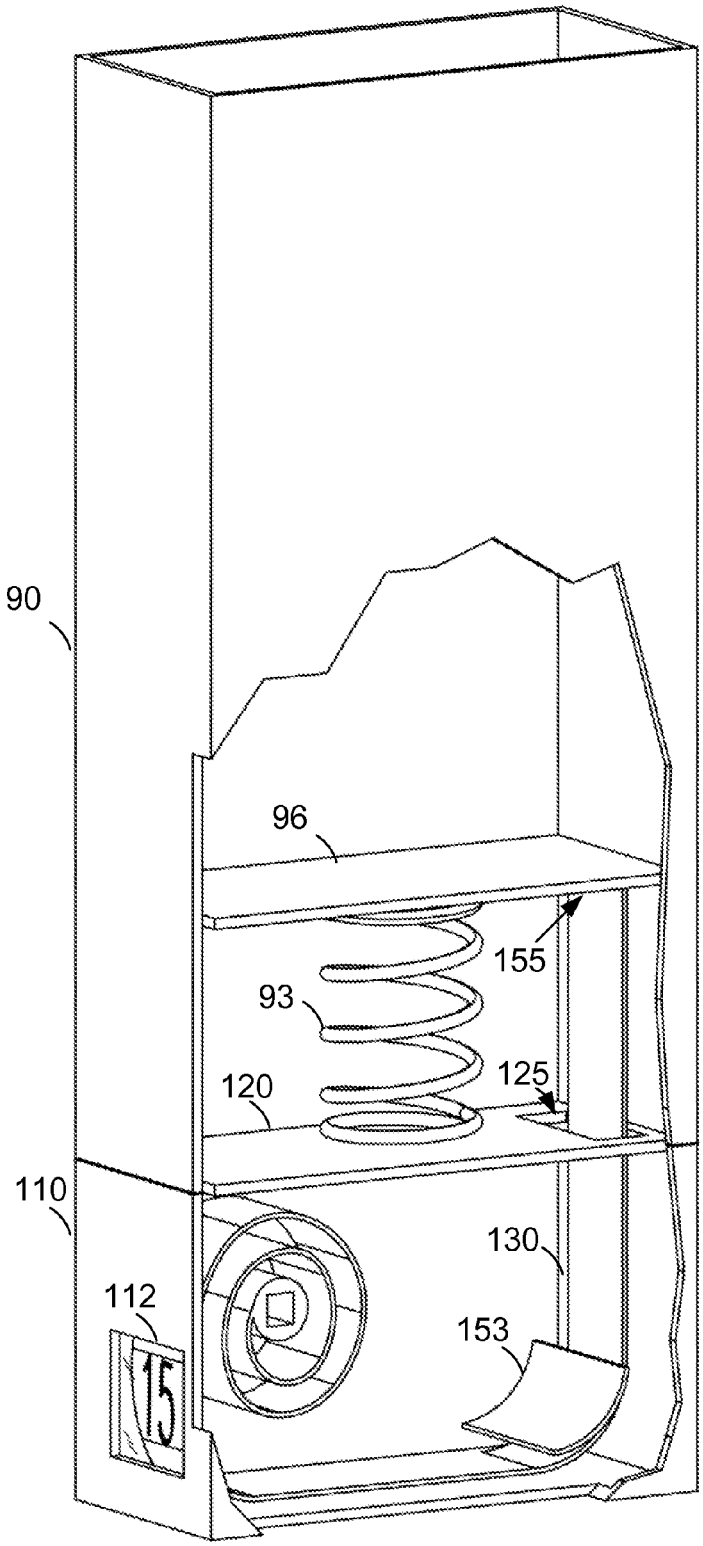
FIGS. 3A, 3B, 4A and 4B are schematic illustrations of the magazine with the apparatus, according to some embodiments of the invention.
Figure 3B:
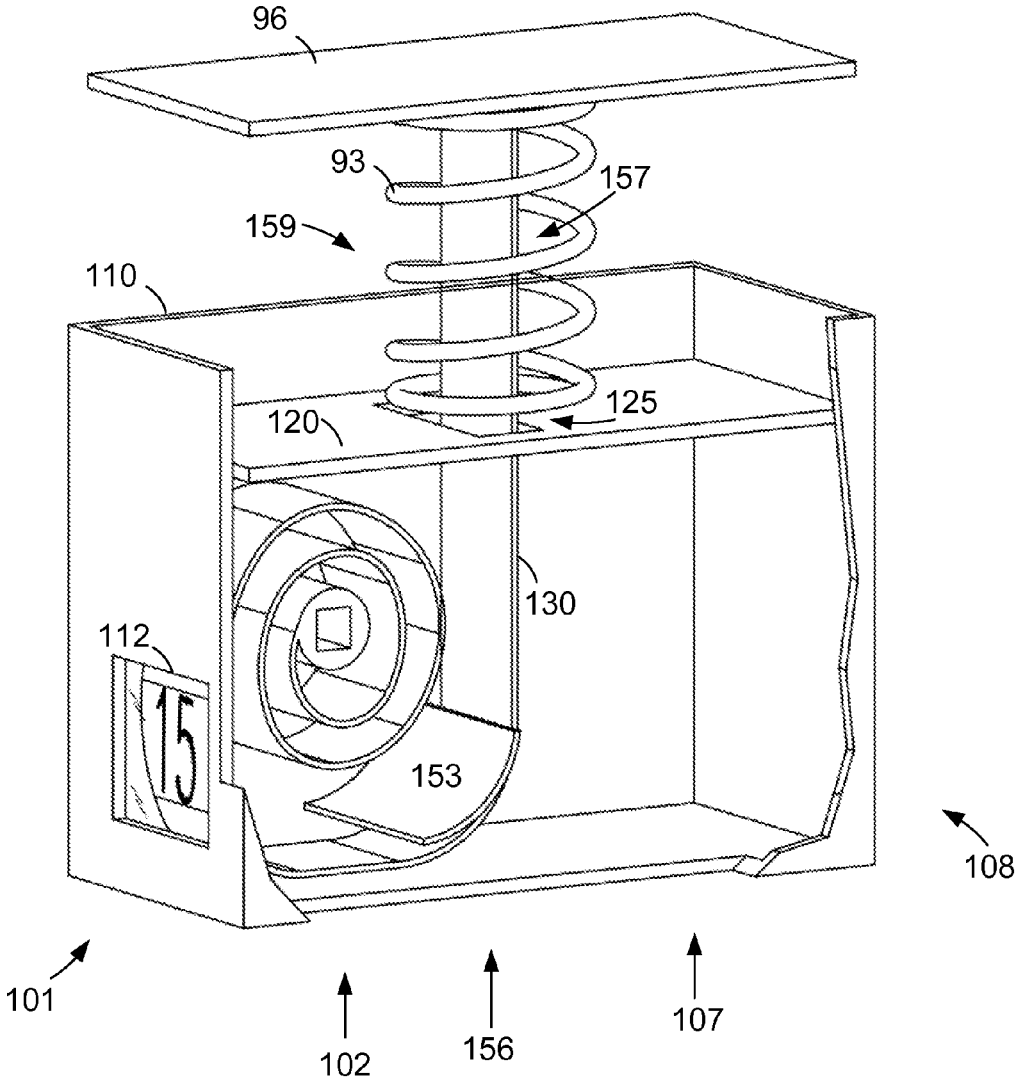

FIGS. 3A and 3B are schematic illustrations of magazine 90 with apparatus 100, according to some embodiments of the invention.

Means for measuring 130 may comprise a coiled elastic strap 150 having an inner end 151 fixated within housing 110 and an outer end 159 stretching through aperture 125 and engaged in an impermanent connection 155 with follower 96. Impermanent connection 155 is arranged to allow disconnecting apparatus 100 from magazine 90 and reusing apparatus 100 with a different magazine.

Means for displaying 140 the number of bullets left in magazine 90 may comprise numbers 141 on a side of coiled elastic strap 150 that faces window 112 from inside housing 110, the numbers increasing towards inner end 151. The numbers may be printed, engraved or attached to strap 150. The displayed area of strap 150, i.e., the area facing window 112, may be variously situated in respect to the coiled part of strap 150—it may be in the back of the coiled part or along straight parts of strap 150 between inner end 151 and outer end 159. Numbers 141 may have contrasting colors in respect to the back of the coiled part, or include other visibility enhancers such as phosphorous markings.

Outer end 159 of strap 150 is arranged to move together with follower 96 such as to uncoil coiled strap 150 and present higher numbers in front of window 112 upon an upward motion of follower 96, and such as to allow coiled strap 150 to elastically re-coil and present lower numbers in front of window 112 upon a downward motion of follower 96. (The directions are in respect to the Top and Bottom markings on FIG. 1.)

The relative positions of window 112 and strap 150 may vary. Strap 150 may be arranged to extend along various paths. For example, window 112 may be positioned on a first narrow edge 101 of apparatus 100 and inner end 151 is fixated in a corresponding first side 102 of apparatus 100, while aperture 125 may be positioned at an opposite narrow edge 108 of apparatus 100 and outer end 159 extend over opposite side 107 through aperture 125 to connect to follower 96 at the opposite narrow side in respect to window 112.

Apparatus 100 may further comprises a support 153 positioned within housing 110 at a lower portion of opposite side 107, and arranged to support extended elastic strap 150.

Alternatively, outer end 159 may extend through a middle 156 of apparatus 100, aperture 125 may be positioned in the middle of platelet 120, and outer end 159 may pass through an inner space 157 of spring 93 and is connected to the middle of follower 96.

Impermanent connection 155 may comprise a connection by a clip (not shown) connected to outer end 159 of strap 150 and operatively attached to follower 96.

Impermanent connection 155 may comprise a magnetic connection between a magnet 152 connected to outer end 159 of strap 150 and follower 96.

Figure 4A:
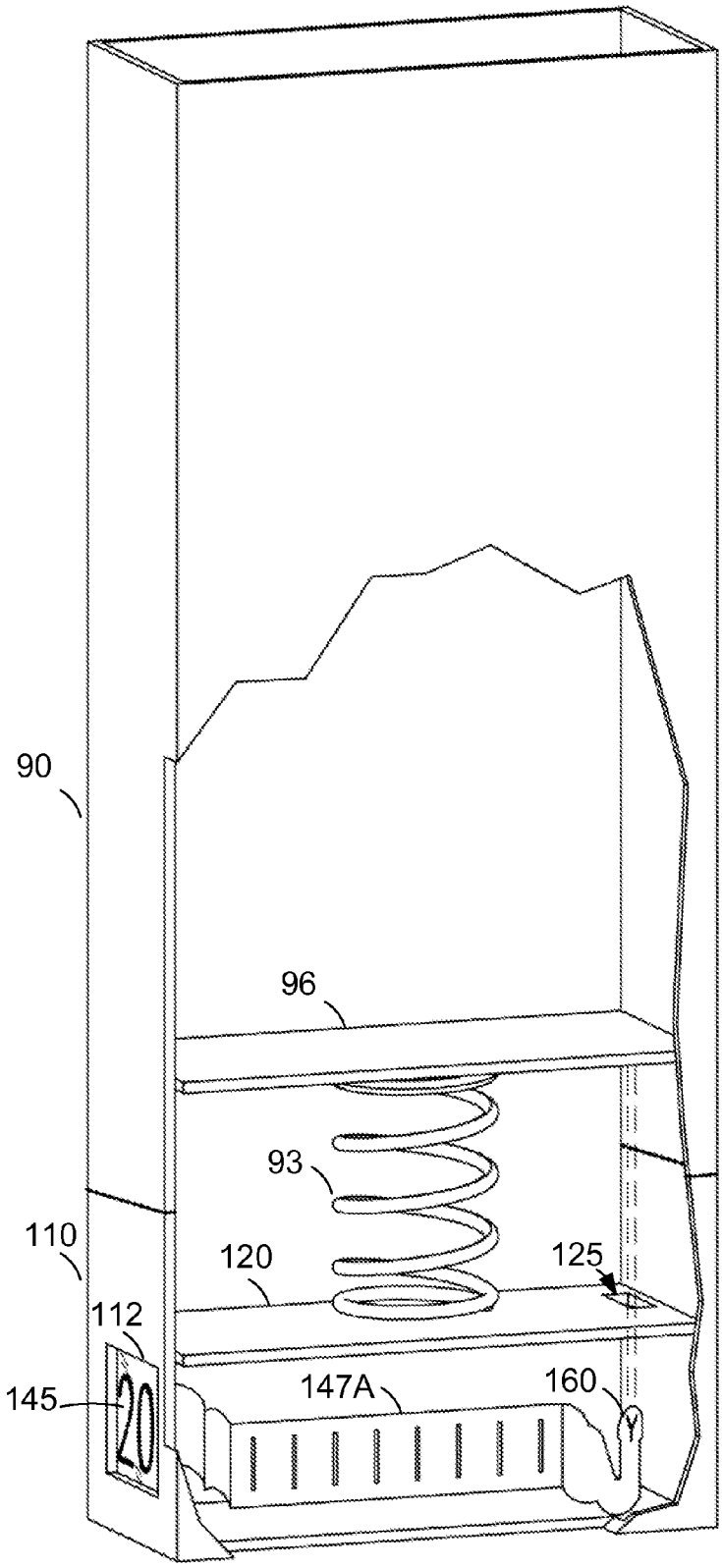
Figure 4B:
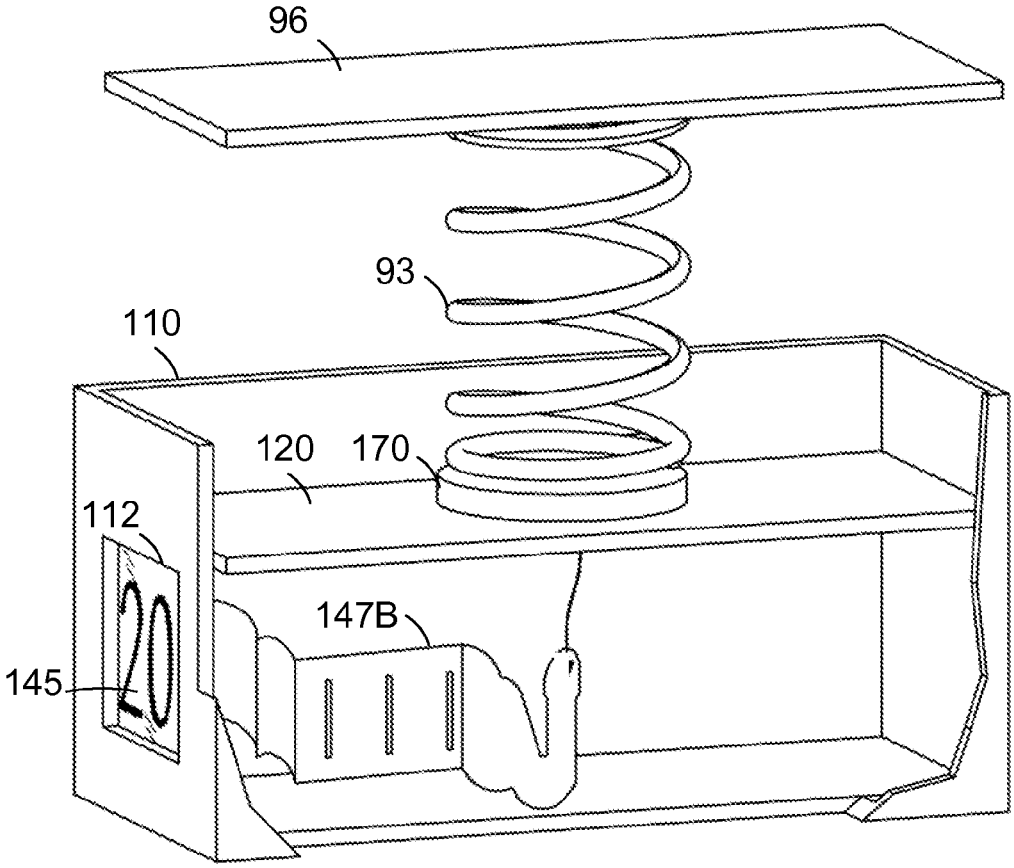

FIGS. 4A and 4B are schematic illustrations of magazine 90 with apparatus 100, according to some embodiments of the invention.

Means for measuring 130 may comprise a rangefinder 160 positioned in housing 110 and arranged to optically measure distance 99 to follower 96 through aperture 125. Means for displaying 140 the number of bullets left in magazine 90 may comprise a display 145, and apparatus 100 may further comprise a controller 147A (e.g., a printed circuit board—PCB) arranged to receive the distance measurement, calculate the number of bullets left in magazine 90 therefrom, and display the number on display 145.

Means for measuring 130 may comprise a pressure sensor 170 such as a piezoelectric sensor, connecting platelet 120 to spring 93 and arranged to measure a pressure applied by spring 93 thereupon. Means for displaying 140 the number of bullets left in magazine 90 may be display 145, and apparatus 100 may further comprise controller 147B arranged to receive the pressure measurement, calculate the number of bullets left in magazine 90 therefrom, and display the number on display 145.

Display 145 may comprise a white on black display for good night visibility, e.g., an OLED (Organic Light Emitting Diode) display. Other types of contrast may be implemented in display 145 to enhance visibility, e.g. phosphorous markings In the above description, an embodiment is an example or implementation of the invention. The various appearances of "one embodiment", "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Furthermore, it is to be understood that the invention can be carried out or practiced in various ways and that the invention can be implemented in embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A magazine add-on attachable to a magazine, the magazine add-on comprising:

a housing attachable to a bottom of the magazine as an add-on and having a spring-loaded follower, the housing having a window;

a platelet arranged to replace a bottom platelet of the magazine, the platelet comprising a connector connectable to the spring and an aperture; and a coiled elastic strap having an inner end fixated within the housing and an outer end stretching through the aperture, the coiled elastic strap arranged to measure a distance between the follower and a point in the housing, wherein the coiled elastic strap comprises numbers on a side thereof that faces the window from inside the housing, the numbers increasing towards the inner end;

wherein the outer end of the strap is arranged to move together with the follower to uncoil the coiled strap and display higher numbers in front of the window upon an upward motion of the follower, and to allow the coiled strap elastically re-coil and display lower numbers in front of the window upon a downward motion of the follower; and wherein the magazine add-on is arranged to be added on to the magazine and display the number of bullets left in the magazine.

2. The magazine add-on of claim 1, wherein the outer end of the coiled elastic strap is engaged in an impermanent connection with the follower.

3. The magazine add-on as claimed in claim 2, wherein the impermanent connection comprises a connection by a clip connected to the outer end of the strap and operatively attached to the follower.

4. The magazine add-on as claimed in claim 2, wherein the impermanent connection comprises a magnetic connection between a magnet connected to the outer end of the strap and the follower.

5. The magazine add-on as claimed in claims 2, wherein the impermanent connection is arranged to allow disconnecting the magazine add-on from the magazine and reusing the magazine add-on with a different magazine.

6. The magazine add-on of claim 1, wherein the window is positioned on a first narrow edge of the magazine add-on and the inner end is fixated in a corresponding first side of the magazine add-on, wherein the aperture is positioned at an opposite narrow side of the magazine add-on and the outer end extends over the opposite side through the aperture to connect to the follower at the opposite narrow side in respect to the window, and wherein the magazine add-on further comprises a support positioned within the housing at a lower portion of the opposite side, and arranged to support the extended elastic strap.

7. The magazine add-on of claim 1, wherein the outer end extends through a middle of the magazine add-on, wherein the aperture is positioned in a middle of the platelet, and wherein the outer end passes through an inner space of the spring and is connected to a middle of the follower.

8. A magazine comprising the magazine add-on as claimed in claim 1.

* * * * *